US008508313B1

(12) United States Patent
Aster

(10) Patent No.: US 8,508,313 B1
(45) Date of Patent: Aug. 13, 2013

(54) MULTICONDUCTOR TRANSMISSION LINE POWER COMBINER/DIVIDER

(75) Inventor: David B Aster, Spokane Valley, WA (US)

(73) Assignee: Comtech Xicom Technology Inc., Santa Clara, CA (US)

( * ) Notice: Subject to any disclaimer, the term of this patent is extended or adjusted under 35 U.S.C. 154(b) by 691 days.

(21) Appl. No.: 12/704,925

(22) Filed: Feb. 12, 2010

Related U.S. Application Data

(60) Provisional application No. 61/152,191, filed on Feb. 12, 2009.

(51) Int. Cl.
*H01P 5/12* (2006.01)

(52) U.S. Cl.
USPC ..... 333/127; 333/136

(58) Field of Classification Search
USPC ..... 333/127, 128, 125, 134, 136
See application file for complete search history.

(56) References Cited

U.S. PATENT DOCUMENTS

| | | | | |
|---|---|---|---|---|
| 3,931,587 | A | 1/1976 | Harp et al. | |
| 4,032,865 | A | 6/1977 | Harp et al. | |
| 4,152,680 | A * | 5/1979 | Harrison | 333/218 |
| 4,188,590 | A | 2/1980 | Harp et al. | |
| 4,238,747 | A | 12/1980 | Harp et al. | |
| 4,266,208 | A * | 5/1981 | Cornish | 333/218 |
| 4,453,139 | A | 6/1984 | Labaar | |
| 4,598,254 | A | 7/1986 | Saito et al. | |
| 4,694,260 | A * | 9/1987 | Argintaru et al. | 331/9 |
| 4,835,496 | A | 5/1989 | Schellenberg et al. | |
| 5,389,890 | A * | 2/1995 | Burrage | 330/124 R |
| 5,644,272 | A * | 7/1997 | Dabrowski | 333/26 |
| 5,777,527 | A * | 7/1998 | Sanders | 333/26 |
| 5,784,033 | A | 7/1998 | Boldissar, Jr. | |
| 5,847,625 | A | 12/1998 | Gillette | |
| 6,005,450 | A | 12/1999 | Schmidt et al. | |
| 6,018,277 | A * | 1/2000 | Vaisanen | 333/26 |
| 6,919,776 | B1 | 7/2005 | Mobius et al. | |
| 7,102,459 | B1 | 9/2006 | Arnold et al. | |
| 7,215,218 | B2 * | 5/2007 | Burns et al. | 333/26 |
| 7,397,328 | B2 * | 7/2008 | Yasuda et al. | 333/204 |
| 7,468,640 | B2 * | 12/2008 | Nosaka | 333/26 |
| 7,479,850 | B2 * | 1/2009 | Kearns et al. | 333/189 |

OTHER PUBLICATIONS

Kenneth J. Russell, 'Microwave power combining techniques,' IEEE Transactions on Microwave Theory and Techniques, May 1979, pp. 472-478.

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. Matthaei, L. Young, E.M.T. Jones, Microwave Filters, Impedance-matching Networks, and Coupling Structures, Artech House Books, Dedham, MA, pp. 585-595.

(Continued)

*Primary Examiner* — Robert Pascal
*Assistant Examiner* — Kimberly Glenn
(74) *Attorney, Agent, or Firm* — Edward B. Weller

(57) ABSTRACT

Devices are described that combine or divide electromagnetic signal power using short-circuited parallel-coupled multiconductor transmission lines. Such devices include single-stage, multi-stage 'traveling wave', and multi-stage broadband filter structures. Electrically shorting each coupled conductor simultaneously provides thermal cooling from heat generated by RF dissipative loss. These features may provide a compact, thermally robust power combiner/divider covering 3:1 bandwidth or greater. The devices may be applicable to radar, electronic countermeasures (ECM), and communications transmitters.

21 Claims, 11 Drawing Sheets

(56) References Cited

OTHER PUBLICATIONS

G. C. Temes and S. K. Mitra, Modern Filter Theory and Design, John Wiley & Sons, New York, New York, 1973, pp. 306-308.

G. Matthaei, L. Young, E.M.T. Jones, Microwave Filters, Impedance-matching Networks, and Coupling Structures, Artech House Books, Dedham, MA, pp. 595-599.

* cited by examiner section 2 - 2 section 3 - 3

Section a1 - a1

Section a2 - a2

MULTICONDUCTOR TRANSMISSION LINE POWER COMBINER/DIVIDER

CROSS REFERENCE TO RELATED APPLICATION

This application claims benefit of, and priority under 35 USC §119(e) from U.S. provisional application No. 61/152,191, entitled "Multiconductor Transmission Line Power Combiner/Divider" filed Feb. 12, 2009, which is incorporated by reference herein in its entirety.

FIELD

The present invention relates generally to devices for summing (or combining) the power of a number of electromagnetic power sources or dividing power into a number of separate divided output signals, and more particularly, to devices using a multiconductor transmission line corporate 'tree' for summing or dividing signal power.

BACKGROUND

The communications and radar industries have had considerable interest in microwave amplifier power combiners featuring non-overmoded compactness, thermal robustness, high combining efficiency, and the ability to perform over a large bandwidth.

One power combining method uses a corporate 'tree' structure (see FIG. 1; see also Kenneth J. Russell, "Microwave power combining techniques," *IEEE Trans. on Microwave Theory and Techniques*, May 1979, pp. 472-478). For example, FIG. 1 is a block diagram of an 8-input, three-stage conventional corporate 'tree' structure that comprises eight isolator-protected source modules 1, 2, 3, 4, 5, 6, 7, and 8 of equal frequency, magnitude, and relative phase delivering combined power to a load 16 through seven 2-input combiner subunits 9, 10, 11, 12, 13, 14 and 15. Each of the 2-input combiner subunits 9-15 may be a three-port structure (two inputs, one output) for which not all ports can be impedance-matched. Alternatively, each of the 2-input combiner subunits 9-15 may have a source isolation port in addition to its output port, thus making it a four-port structure with all ports impedance-matched. The three combining stages include stage 'A' formed of the combiner subunit 15, stage 'B' formed of the combiner subunits 13 and 14, and stage 'C' formed of the combiner subunits 9-12. Transmission lines 17, 18, 19, 20, 21, and 22 separate each stage. Typically, each transmission line 17-22 has a uniform impedance, impedance-matched to its mating port on each end, and has a length compatible with convenient separation of the 2-input combiner subunits 9-15. The large number of separate components for this prior art approach, and the physical space used for the overall structure, is often problematic, especially for low-frequency applications.

Another restriction is its useful bandwidth, which is limited to that of the individual combiner subunits. This bandwidth is further compromised due to adverse summing of the individual stage vector reflection coefficients within the corporate combiner structure.

An additional disadvantage of this prior art approach is that the combining efficiency of the corporate structure is compromised. This is due to the large number of separate components which contribute RF losses and also due to stage-to-stage reflection coefficient scattering which exacerbates the overall combiner loss.

The corporate 'tree' approach typically uses 2-input combiner subunits. This limits application to $2^N$ input sources, where N is the number of combining stages. Therefore it is not possible to power combine, say, twelve input sources using the prior art corporate structure approach.

SUMMARY

The N-stage power combiner/divider is summarized for clarity as a power divider with N=2. A two-stage power combiner/divider comprises a first power divider stage, a plurality of transmission lines, and a second stage comprising a plurality of second power dividers. The first power divider stage comprises a first main conductor that includes a first terminal for electrical connection to a signal source and includes a second terminal electrically connected to a short circuit. A plurality of first satellite conductors is disposed symmetrically spaced apart from and substantially parallel to the first main conductor. Each of the first satellite conductors includes a first terminal electrically connected to a short circuit. Each transmission line includes a first terminal electrically connected to a second terminal of a respective first satellite conductor. Each second power divider belonging to the second stage comprises a second main conductor and a plurality of second satellite conductors. The second main conductor includes a first terminal electrically connected to a second terminal of a corresponding transmission line and includes a second terminal electrically connected to a short circuit. Each second satellite conductor is disposed symmetrically spaced apart from and substantially parallel to the second main conductor. Each second satellite conductor includes a first terminal electrically connected to a short circuit and includes a second terminal electrically connected to a respective termination admittance. There are a total of $(N_{S1} \cdot N_{S2})$ such termination admittances, where there are $N_{S1}$ number of first stage satellite conductors and an $N_{S2}$ number of second stage satellite conductors. Each of these termination admittances receives substantially $1/(N_{S1} \cdot N_{S2})$ of the incident signal power incident to the first terminal of the first main conductor of the first power divider stage—assuming, for purposes of descriptive summary, a perfectly matched and lossless structure.

A first aspect of the present invention is summarized as a single-stage multiconductor transmission line combiner/divider, where the stage cross-section geometry may be designed for optimum scattering parameter performance at an operating frequency $f_0$.

A second aspect of the present invention is summarized as two or more stages, where the cross-section geometry for each stage may be designed individually and independently for optimum scattering parameter performance at the operating frequency $f_0$. This is defined as a 'traveling wave' design for optimum scattering parameter performance at frequency $f_0$.

A third aspect of the present invention is summarized as incorporating a passband filter design for two or more combiner/divider stages, where the stage multiconductor transmission line cross-section geometries are interdependently designed for passband filter scattering parameter performance over a frequency range $f_{LOW} \leqq f \leqq f_{HIGH}$. This aspect of the present invention may be demonstrated as a two-stage coax multiconductor combiner/divider structure with the ratio $f_{HIGH}/f_{LOW}$ approximately equal to 2.

Each of the summarized aspects of the present invention may include thermal robustness due to the electrical short circuit connection of one end of each main and satellite conductor to 'ground'. Any heat created from RF dissipative loss on the main or satellite conductors may be thermally conducted to the short-circuit ground connection. Thus, every conductor within a combiner stage may serve as a thermal heat pipe, serving to cool the overall combiner structure. This constitutes another feature of the present invention, making possible the power combining/dividing of high-average-power RF signal amplifiers.

DETAILED DESCRIPTION

Various embodiments of the present invention are now described with reference to the figures where like reference numbers indicate identical or functionally similar elements. Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

In one aspect, the present invention combines the corporate 'tree' with an N-way non-resonant combiner using successive stages of coupled multiconductor transmission lines (see Clayton R. Paul, Analysis of Multiconductor Transmission Lines, John Wiley & Sons, New York, N.Y., 1994 for description and modeling of multiconductor transmission lines). Although one-stage and two-stage power combiner/dividers are described, the power combiner/dividers of the present invention are not so limited, but may include any number of stages. For the sake of simplicity and convenience, the embodiments of the present invention are presented as power dividers as described next, but may be used as power combiners.

Figure 2A:
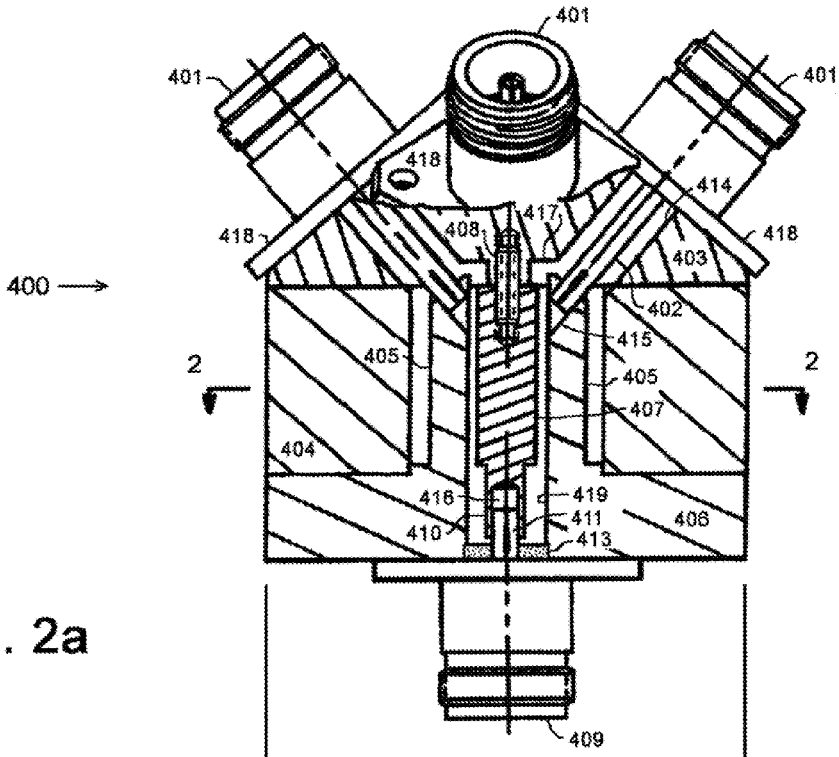
FIGS. 2*a* and 2*b* are an orthographic cutaway view and a cross-sectional view along a line 2-2 of FIG. 2*a*, respectively, of a single-stage 4-way divider/combiner according to the first aspect of the present invention.
Figure 2B:
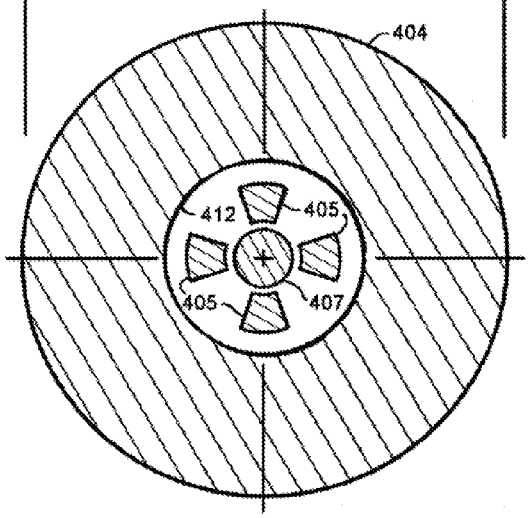
Figure 2C:
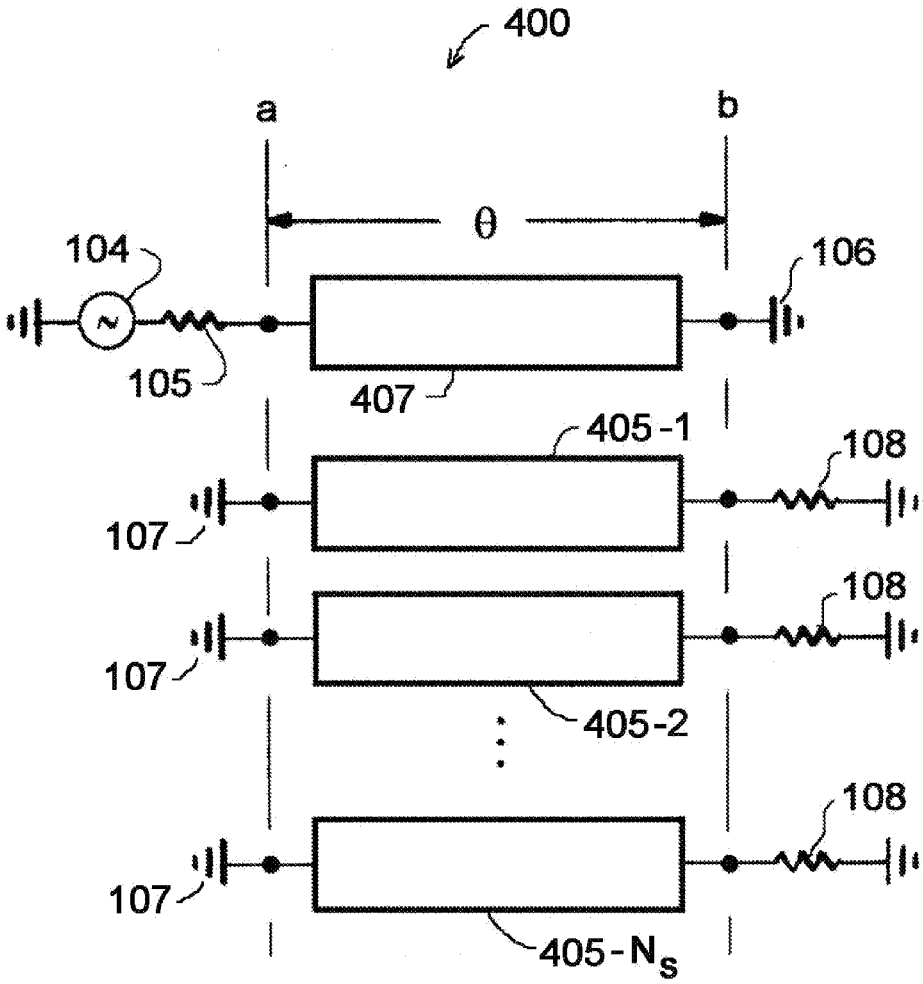
FIG. 2*c* is a generalized electrical schematic of the single-stage 4-way combiner/divider of FIGS. 2*a* and 2*b*.

FIGS. 2*a* and 2*b* are an orthographic cutaway view and a cross-sectional view along a line 2-2 of FIG. 2*a*, of a single-stage $N_S$-way divider 400, respectively, according to the first aspect of the present invention, where the quantity $N_S=4$. FIG. 2*c* is a generalized electrical schematic of the single-stage 4-way combiner/divider 400 of FIGS. 2*a* and 2*b*. The cross-sectional view of FIG. 2*b* depicts a multiconductor transmission line comprising a conducting shield 412, a plurality of satellite conductors 405, and a main conductor 407. The 4-way single-stage divider 400 comprises an input coaxial connector 409 and four output coaxial connectors 401. The center conductors 402 of each of the four output connectors 401, and the inner diameter of the bores 414 constitute simple coaxial transmission lines with characteristic impedance identical to that of their respective output connectors 401. Each transmission line is fed at the end of each of four satellite transmission lines 405. The four satellite conductors 405 symmetrically surround the main conductor 407. In one embodiment, the perimeter of each of the satellite conductors 405 is symmetric about the axis of the main conductor 407 with respect to each other. The main conductor 407 is shorted to ground where it mates to the conductive base 403. Each of the satellite conductors 405 is electrically shorted to ground at the location where they join an electrically conductive plate 406, which may be formed of a thermally conductive material. The slotted ends of the four output feed center conductors 402 are received by a bore 415 in the end of each satellite conductor 405. Alternatively, this connection may be soldered or brazed. The main conductor 407 may be thermally and electrically mounted to the conducting base 403 by a threaded fastener 408, or alternatively by soldering or brazing joining methods. The main conductor 407 may also comprise a thermally conductive material, and may be plated to form a suitable electrically conductive outer surface. Although the four satellite conductors 405 and the conductive plate 406 are shown in FIG. 2*a* as one integral piece part, they may be formed separately and assembled. Each of the four output connector flanges 418 are shown mounted (mounting screws not shown in FIGS. 2*a* and 2*b*) on a base 403, which may be formed of an electrical conductor, or which has all surfaces plated with an electrically conductive material. In one embodiment, the base 403 is thermally conductive. The base 403 is contoured 417 to aid in minimizing power reflection due to junction reactances. The inner diameter 419 of the plate 406 is also the inner diameter of the satellite conductors 405. The inner diameter 419 also serves as the outer conductor of the input coaxial transmission line which has an inner conductor 410. The input connector 409 has a slotted center conductor which is received by a bore 416 on the end of the input transmission line center conductor 410; this connection alternatively may be soldered or brazed. The input connector dielectric 413 is received by a counterbore in the conductive plate 406. The counterbore axis is aligned with the main conductor axis. Although the divider 400 is shown in FIG. 2*a* to include a coaxial input connector 409, the input transmission line center conductor 410 instead, 1) may be fed by a transmission line centering bullet assembly (comprised of a centering dielectric bead 504, and slotted-end center conductor 505 shown in FIG. 3*a*, for example) connected to a previous combiner stage separation transmission line, or 2) may be fed by a waveguide-to-coax transition, where the input is a waveguide instead of the coaxial connector 409. In one embodiment, the output center conductors 402 may be connected to coax-to-waveguide transitions, where four waveguides replace the coaxial connectors 401.

Figure 4A:
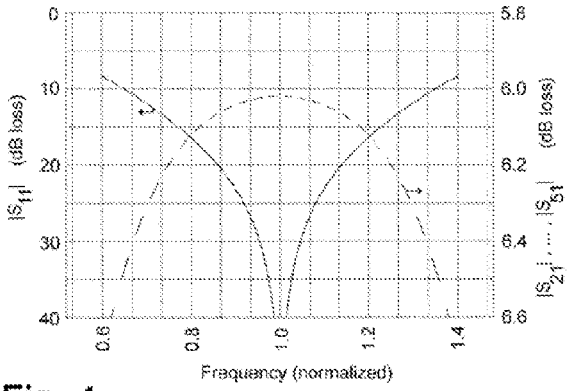
FIG. 4*a* is a graph illustrating a calculated scattering matrix response of a single-stage 4-way divider 400 of FIGS. 2*a* and 2*b* according to the first aspect of the present invention.
Figure 4B:
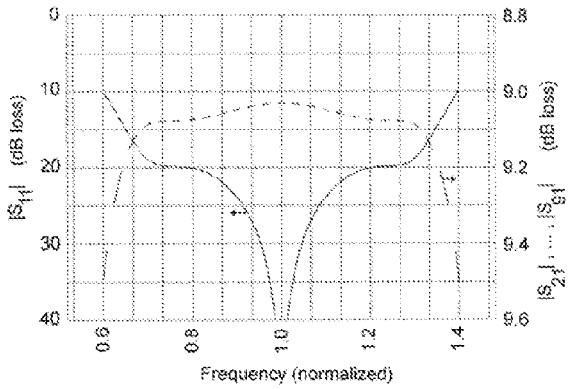
FIG. 4*b* is a graph illustrating a calculated scattering matrix response of the two-stage 1:8 divider 500 of FIGS. 3*a*, 3*b*, as designed for 'traveling wave' operation according to the first and second aspects of the present invention.

In one embodiment of the present invention, described as a power divider: 1) the multiconductor transmission line (MTL), with a substantially uniform cross-section as shown in FIG. 2*b*, is designed to have an effective phase length equal to one quarter-wavelength at the operating midband frequency $f_0$; 2) the admittance matrix for this multiconductor cross-section is designed such that near-perfect power division to the four output connectors 401 and near-zero reflection at the input connector 409 is achieved at the operating midband frequency $f_0$. Referring to FIG. 2*c*, this scattering matrix performance at $f_0$ may be achieved where the cross-section dimensions of the multiconductor transmission line of FIG. 2*b* are such that the associated admittance matrix element values $Y_{(1)(2)}, \ldots, Y_{(1)(NS+1)}$ are substantially equal to $\sqrt{Y_{(105)}Y_{(108)}/(N_S)}$, where the number $Y_{(105)}$ represents the source input characteristic admittance 105, the number $Y_{(108)}$ represents the termination admittance 108 for each satellite conductor 405-1 through 405-$N_S$, and $N_S$ is the number of satellite conductors. In the above notation for the admittance matrix element value $Y_{(1)(x)}$, the first subscript index is associated with the main conductor 407, and the second subscript represents the column index number associated with its respective satellite conductor 405-1 through 405-$N_S$. An example of an $N_S$=4 power divider designed in this manner gives the 'divider operation' scattering parameter performance as shown in FIG. 4*a*. The $|S_{11}|$ trace shows near-perfect match at $f/f_0$=1.0 with one quarter (6.02 dB) of the power input to the divider being coupled onto each of the four satellite line output connectors—traces $|S_{21}|$ through $|S_{51}|$.

Referring to FIG. 2*c*, the single-stage N-way combiner/divider 400 is shown schematically. A signal source 104 with source admittance 105 feeds the main conductor 407 at a reference plane a. The main conductor 407 terminates in a short circuit 106 at a reference plane b. The satellite lines 405 terminate in corresponding short circuits 107 at the reference plane a, and are coupled to corresponding finite-magnitude termination admittances 108 at the reference plane b. At the operating frequency $f_0$, the phase length θ separation between the reference planes a and b is one quarter-wavelength.

If operating the single-stage device 400 as a combiner, a quantity $N_S$=4 isolator-protected sources of the same frequency, relative phase and magnitude feeding the input connectors 401 sum along the multiconductor transmission line (of cross-section as shown in FIG. 2*b* as designed according to the first aspect of the present invention) delivering the combined power to the output connector 409 at the operating midband frequency $f_0$.

The number $N_S$ of satellite conductors 405 is equal to 4 for the divider/combiner 400 shown in FIGS. 2*a*, 2*b*. Not limited to $N_S$=4 satellite conductors, this aspect of the present invention $N_S$-way divider/combiner may be designed and built with any number $N_S$ satellite conductors 405. Consistent with the first aspect of the present invention, the multiconductor cross-section geometry dimension admittance matrix for a selected value of $N_S$ is designed such that near-perfect power division from the main conductor input to the $N_S$ satellite output connectors and near-zero reflection at the input connector 409 is achieved at the operating midband frequency $f_0$.

Although the satellite conductors 405 are described as being arranged spaced apart symmetrically about the main conductor 407 (in FIGS. 2*a*, 2*b* for $N_S$=4, for example), the divider/combiner of this first aspect of the present invention may include other spatial configurations of the satellite conductors 405 about the main conductor 407. Although the satellite conductors 405 are described in FIG. 2*b* with the quasi-rectangular individual cross-sections as shown, the combiner/divider 400 satellite conductors may be formed with other dimensions, shapes (such as circular or elliptical) and placement configurations. Similarly, the main conductor 407 and conductive shield 412 are shown in FIG. 2*b* with circular cross-sections, but may be formed with other dimensions, shapes (such as, but not limited to, rectangular or hexagonal) and placement configurations.

Figure 3B:
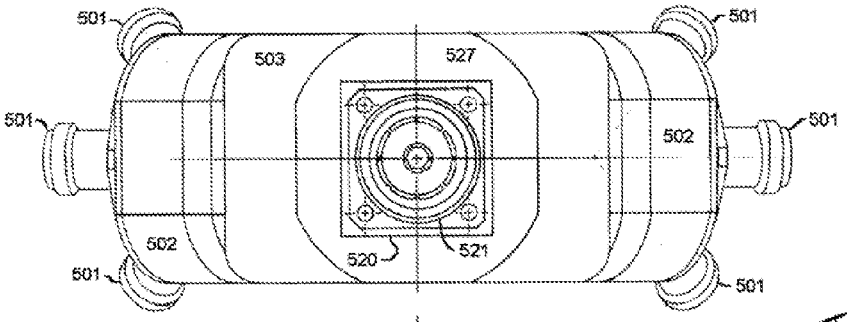
FIGS. 3*a* and 3*b* are orthographic views of one embodiment of the two-stage 1:8 divider/combiner according to either the second or third aspects of the present invention.
Figure 3C:
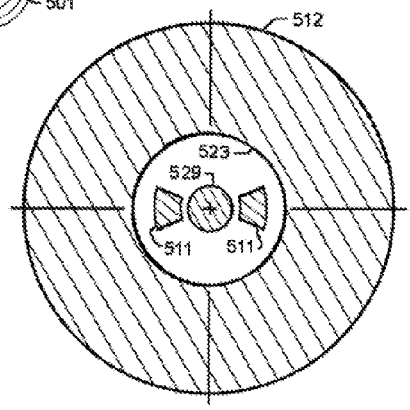
FIG. 3*c* is a cross-sectional view (section 3-3) of the two-stage 1:8 divider/combiner of FIG. 3*a*.
Figure 3A:
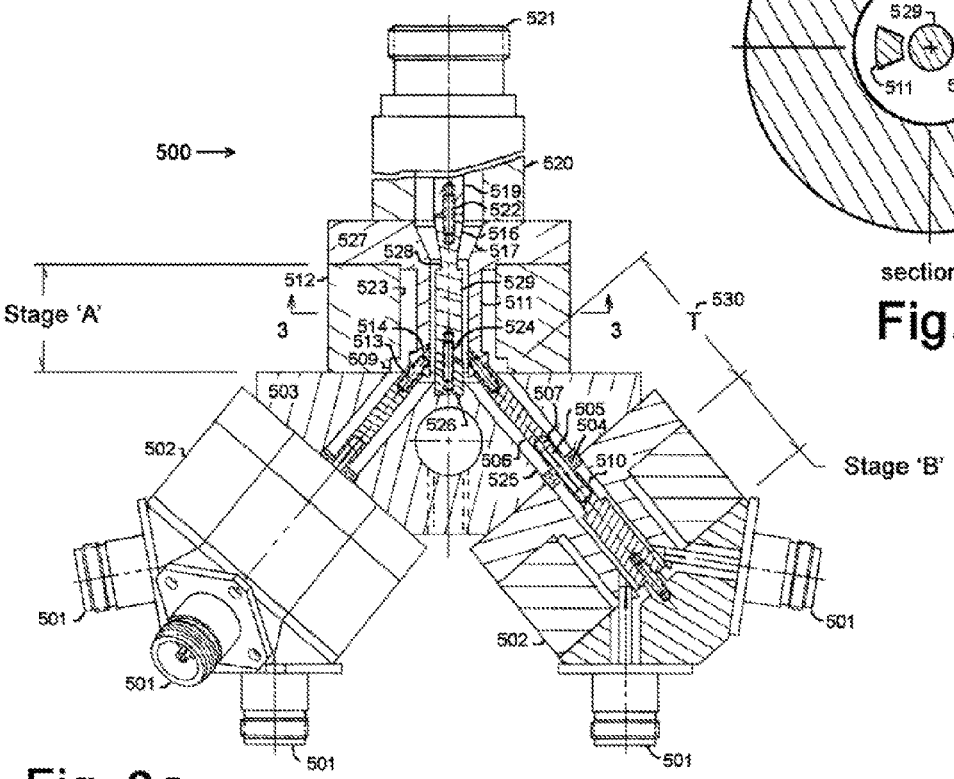
Figure 3D:
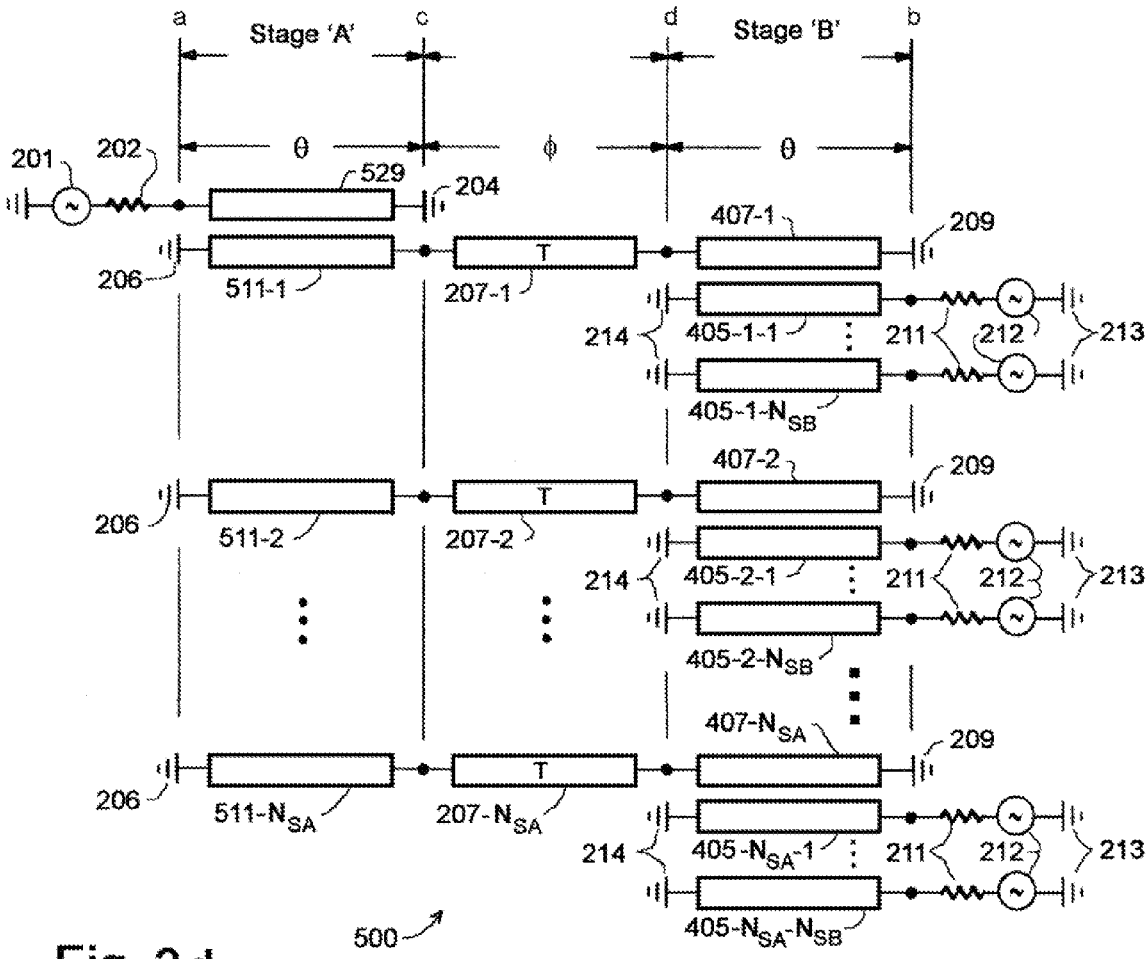
FIG. 3*d* is a generalized schematic of a two-stage corporate 'tree' combiner/divider of FIGS. 3*a*, 3*b* and 3*c*.

FIGS. 3*a* and 3*b* are orthographic views of a two-stage 1:8 corporate 'tree' divider/combiner 500, according to a second embodiment of the present invention. FIG. 3*d* is a generalized schematic of a two-stage corporate 'tree' combiner/divider 500. Describing the two-stage 1:8 corporate 'tree' divider/combiner 500 as a power divider for convenience, input signal power entering coaxial connector 521 feeds a coaxial input transmission line with an outer conductor housing 520 and a center conductor 519. The center conductor 519 is connected by a threaded fastener 522 to a conical transmission line center conductor 516 (with a conical outer conductor shield 517) to a coaxial transmission line with a center conductor 528. The characteristic impedance of the input connector 521 is maintained throughout the transmission lines so described. Signal power on the center conductor 528 in turn feeds the main conductor 529 of an $N_{SA}$-way divider multiconductor transmission line which extends over a physical length designated as stage 'A' in FIG. 3*a*, and has an effective phase length equal to one-quarter-wavelength at the midband operating frequency $f_0$. The stage 'A' multiconductor transmission line cross-sectional view along line 3-3 (FIG. 3*a*) is shown in FIG. 3*c*. The transmission line comprises an outer conductor shield 523, a main conductor 529, and a plurality of satellite conductors 511 symmetrically spaced apart from and parallel to the main conductor 529. In one embodiment, each of the plurality of satellite conductors 511 has a substantially identical cross-section with the other conductors 511. Perimeters of each of the satellite conductors 511 are symmetric about the axis of the main conductor 529 with respect to each other.

The stage 'A' main conductor 529 is electrically, mechanically and thermally connected using a threaded fastener 524 to a conductive block 526 which is press-fit or soldered to a thermally and electrically conductive base 503. The number $N_{SA}$ of satellite conductors equals two in the illustrative embodiment depicted in FIGS. 3*a* and 3*c*. Each satellite conductor 511 is connected to a thermally and electrically conductive ground plate 527. FIG. 3*a* shows that both satellite conductors 511 and the plate 527 are one single piece part, but may be formed as separate pieces. Each of the quantity $N_{SA}$ satellite conductors is electrically and mechanically connected by a respective threaded fastener 513 to a center conductor 506 which is part of a respective stage separation transmission line with a conductive shield 525. In lieu of a threaded fastener 513, this connection may be soldered or brazed. Both input center conductors 506 comprise thermally conductive material, and have corresponding exteriors plated with an electrically conductive and corrosion-resistant outer surface layer. The center conductor 506 is shown in FIG. 3*a* with a counterbore 507 which receives a slotted-end center conductor 505 of a centering bullet assembly including a dielectric centering bead 504. Each of the quantity $N_{SA}$ centering bullet assembly transmission line center conductors 505 feeds a main conductor 510 of a respective second stage T $N_{SB}$-way divider 502. The number $N_{SB}$ satellite conductors 405 (FIG. 3*d*) for each of the quantity $N_{SA}$ stage 'B' dividers 502 equals four in the illustrative embodiment shown in FIGS. 3*a*, 3*b*. Each of the two stage T dividers 502 is the same divider embodiment 400 shown in FIGS. 2*a* and 2*b*, except where the input connector 409 with slotted center conductor 411 is replaced with the input centering bullet assembly comprising the dielectric centering bead 504 and the slotted-end center conductor 505 shown in FIG. 3*a*. Each stage T divider 502 input center conductor 510 shown in FIG. 3*a* is also labeled as 410 in FIG. 2*a*.

Combining the first and second aspects of the present invention, a 'traveling wave' combiner/divider is formed by first optimizing the scattering parameter performance at the frequency $f_0$ for each of the two 4-input combiner subunits 502, second by choosing conductor diameters of the transmission lines 506, 525 such that these two separation transmission lines 506, 525 have the same characteristic admittance as that for: a) the output transmission line of each 4-input combiner subunit 502, and b) the input design impedance of the 2-input combiner unit, and third by optimizing the scattering parameter performance at the frequency $f_0$ for the 2-input combiner subunit. In other words, each of the three combiner subunits is designed for optimum scattering parameter performance at the frequency $f_0$ independently from each other. In this second aspect of the present invention, the two separation transmission lines comprised of inner and outer conductors 506 and 525, respectively, may have a length that is different from one quarter-wavelength at $f_0$.

In the third aspect of the present invention, a 'broadband' combiner/divider is formed by 1) making the length of the separation transmission lines (referring to FIG. 3*a*, comprised of inner and outer conductors 506 and 525, respectively) equal to one quarter-wavelength at the mid-band frequency $f_0$, and 2) designing the stage 'A' and 'B' multiconductor transmission line admittance matrices and separation transmission line admittances together in such a way as to form a passband filter.

A passband filter circuit model for the present multi-stage combiner/divider invention is arrived at by first finding the wave admittance function for the single-stage combiner/divider circuit shown in FIG. 2*c* (see Clayton R. Paul, *Analysis of Multiconductor Transmission Lines*, John Wiley & Sons, New York, N.Y., 1994). At reference plane 'a' in FIG. 2*c*, the main conductor 407 wave admittance is found to be $$Y_a = \frac{\mu(s^2 - 1) + Y_{11}(s + \xi)}{s(s + \xi)}$$

where $$s = j\tan\theta;\ \theta = \frac{\pi}{2}\frac{f}{f_0};\ \mu = N_S Y_{12}^2 / Y_L;$$

$$\xi = (Y_{22} + Y_{23}\varepsilon_{N_S}) / Y_L$$

$$\varepsilon_1 = 0;\ \varepsilon_2 = 1;\ \varepsilon_{N_S} = 2;\ \text{for } N_S > 2.$$

In the above notation, the frequency of operation is f, the mid-band frequency is $f_0$, the number of satellite conductors 405-1 through 405-$N_S$ symmetrically surrounding the main center conductor 407 is $N_S$, and $Y_{mn}$ is the mth row and nth column component of the admittance matrix for this multiconductor transmission line. Each satellite conductor 405-1 through 405-$N_S$ terminates in an admittance 108 of value $Y_L$, referring again to FIG. 2*c*.

Figure 6A:
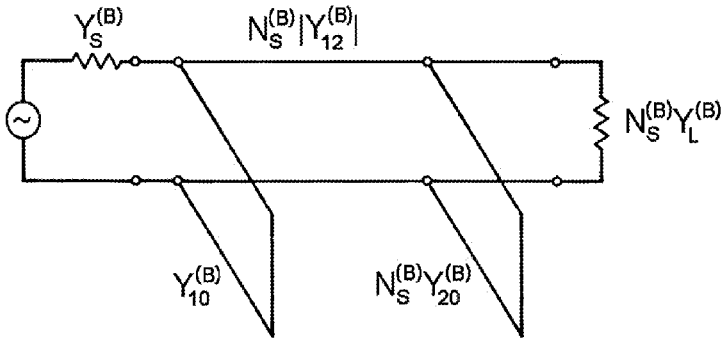
FIG. 6*a* is a schematic diagram illustrating an extracted filter circuit corresponding to FIG. 2*c*.

Using Richard's Theorem, the extracted filter circuit (see G. C. Temes and S. K. Mitra, *Modern Filter Theory and Design*, John Wiley & Sons, New York, N.Y., 1973) is shown in FIG. 6*a*. Operating as a divider, this equivalent 'ladder circuit' is composed of simple shorted stub transmission lines which are 'unit elements' (quarter-wavelength at the mid-band frequency $f_0$), each separated by a unit element transmission line. The filter circuit transmission line characteristic admittances are shown, as well as a source admittance of value $Y_S^{(B)}$ (corresponding to 105 in FIG. 2*c*) and a circuit termination admittance $N_S^{(B)}Y_L^{(B)}$, where $Y_L^{(B)}$ corresponds to a stage 'B' termination admittance 108 in FIG. 2*c*.

Figure 4C:
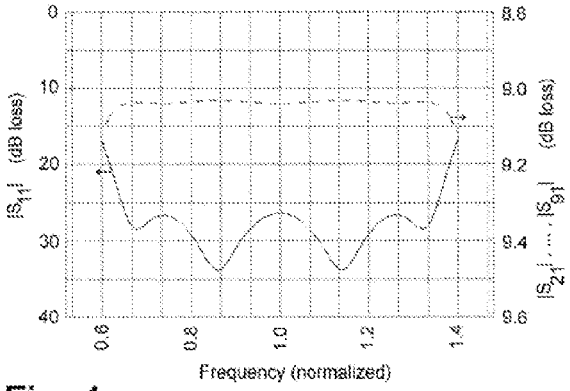
FIG. 4*c* is a graph illustrating a calculated scattering matrix response of the two-stage 1:8 divider 500 of FIGS. 3*a*, 3*b*, as designed for approximately octave bandwidth operation according to the third aspect of the present invention.
Figure 6B:
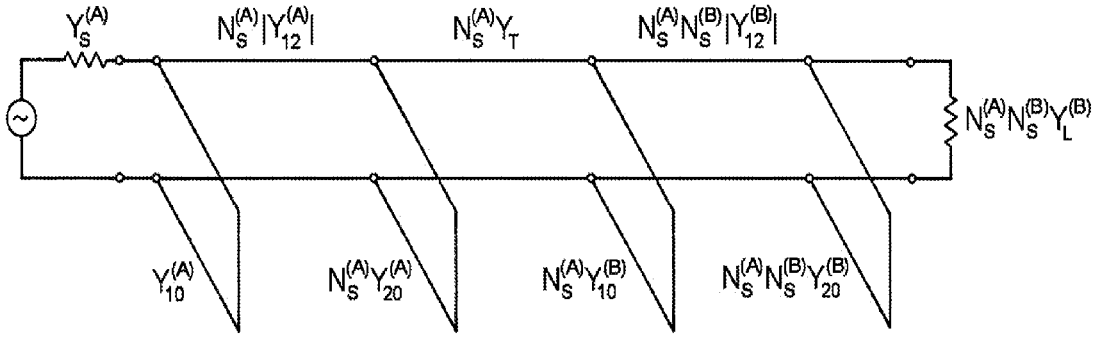
FIG. 6*b* is a schematic diagram illustrating an extracted filter circuit corresponding to FIG. 3*d*

The extension of this procedure for a two-stage combiner/divider is shown in FIG. 6*b*. The number of shorted stub transmission lines is equal to twice the number of stages, each shorted stub separated by transmission lines that are also 'unit elements', that is, a quarter-wave at the mid-band frequency $f_0$. The characteristic admittance for each transmission line is shown in FIG. 6*b*, as well as the termination admittance for the ladder circuit. This termination admittance $N_S^{(A)}N_S^{(B)}Y_L^{(B)}$ is, in general, not equal to the ladder circuit stage 'A' source admittance $Y_S^{(A)}$. In this notation, $Y_L^{(B)}$ corresponds to the value of each load admittance 211 shown in FIG. 3*d*, and $Y_S^{(A)}$ corresponds to the value of the stage 'A' main conductor 529 source admittance 202 in FIG. 3*d*. The separation transmission line characteristic admittance $Y_T$ shown in FIG. 6*b* corresponds to the characteristic admittance of each separation transmission line 207-1 through 207-$N_S^{(A)}$ shown in FIG. 3*d*. Ladder circuit admittances (FIG. 6*b*) yielding a bandpass filter response substantially analagous to the scattering parameter vs. frequency response shown in FIG. 4*c* are chosen using many possible methods. One approach is to use modern filter analysis techniques (see G. C. Temes and S. K. Mitra, *Modern Filter Theory and Design*, John Wiley & Sons, New York, N.Y., 1973). They may also be determined by an extension of the bandpass filter design theory presented in section 10.03 of *Microwave Filters, Impedance-Matching Networks, and Coupling Structures*, by G. Matthaei, L. Young, and E. M. T. Jones, Artech House, Dedham, Mass., 1980 edition, the contents of these sources which are incorporated herein by reference in their entirety. Whatever bandpass filter design method is used, and not limited to those techniques cited here, a feature of this aspect of the invention is that all admittances of the two-stage 'corporate tree' function together interdependently to form a bandpass filter.

Figure 4D:
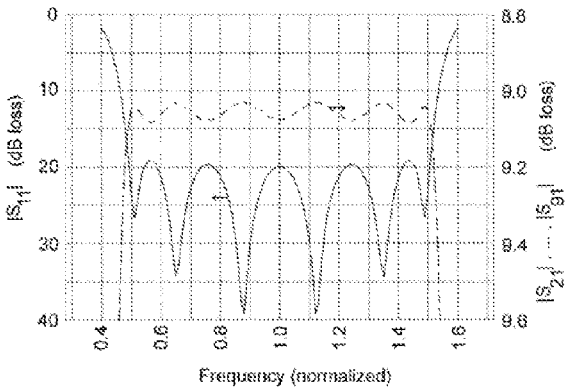
FIG. 4*d* is a graph illustrating the calculated scattering matrix response of a three-stage 1:8 divider, as designed for 3:1 bandwidth operation according to the third aspect of the present invention where $N_{SA}=N_{SB}=N_{SC}=2$.
Figure 6C:
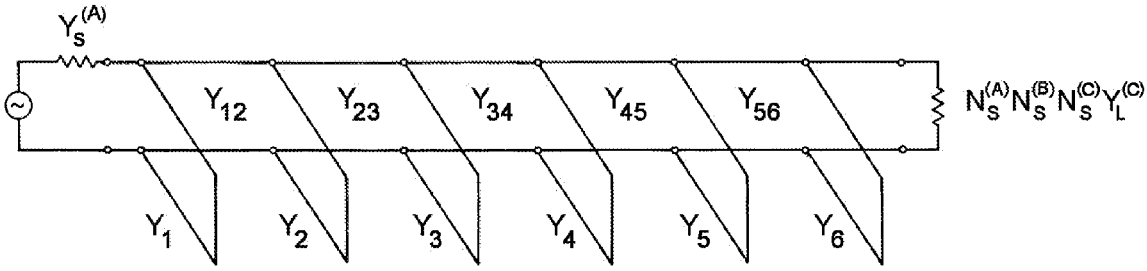
FIG. 6*c* is a schematic diagram illustrating a filter circuit model for a three-stage combiner/divider using quarter-wave separation transmission lines between each stage.

The filter circuit model for a three-stage combiner/divider using quarter-wave separation transmission lines between each stage is shown in FIG. 6*c*. Depicted is a divider ladder circuit with stage 'A' main conductor source admittance $Y_S^{(A)}$ and a circuit termination admittance equal to $N_S^{(A)}N_S^{(B)}N_S^{(C)}Y_L^{(C)}$. For the sake of brevity, the shunt stub ladder admittances are labeled $Y_1$ through $Y_6$, and the intervening unit element transmission line characteristic admittances are labeled $Y_{12}$ through $Y_{56}$. Using any of the passband filter design methods cited above, the ladder circuit admittances shown in FIG. 6*c* can be found giving scattering parameter performance substantially analogous to that shown in FIG. 4*d*. Again, a feature of this aspect of the invention is that all admittances of the three-stage 'corporate tree' function together interdependently to form a bandpass filter.

Referring now to FIG. 3*d*, a signal source 201 with a source admittance 202 feeds a main conductor 529 at the reference plane a. A quantity $N_{SA}$ satellite conductors 511-1 through 511-$N_{SA}$ are arranged spaced apart symmetrically, in an orthogonal cross sectional view, about the main conductor 529. The main conductor 529 terminates in a short circuit 204 at a reference plane c. The satellite conductors 511-1 through 511-$N_{SA}$ terminate in corresponding short circuits 206 at the reference plane a, and are coupled to corresponding transmission lines (T) 207-1 through 207-$N_{SA}$ at the reference plane c. This constitutes a stage 'A'. At the operating frequency $f_0$, the phase length θ separation between the reference planes a and c is one quarter-wavelength. Each of the quantity $N_{SA}$ transmission lines 207-1 through 207-$N_{SA}$, having a phase length ϕ, delivers its share of the stage 'A' subdivided power to a corresponding main conductor 407-1 through 407-$N_{SA}$ of a stage 'B' at a reference plane d. In one embodiment, there is a quantity $N_{SA}$ such stage 'B' dividers. In one embodiment, the transmission lines 207-1 through 207-$N_{SA}$ each comprise a simple transmission line with a single center conductor and outer conductor.

In the stage 'B', each of the quantity $N_{SA}$ groups of quantity $N_{SB}$ satellite conductors 405-*x*−1, . . . , 405-*x*-$N_{SB}$ (x=1, . . . , $N_{SA}$) are arranged spaced apart symmetrically, in an orthogonal cross sectional view, about each of the respective main conductors 407-1 through 407-$N_{SA}$. Each main conductor 407-1 through 407-$N_{SA}$ terminates in a short circuit 209 at the reference plane b. Each set of satellite lines 405-1-1 through 405-$N_{SA \cdot NSB}$ terminates in corresponding short circuits 214 at the reference plane d, and each set is coupled to corresponding finite-magnitude admittance terminations 211 at the reference plane b. In this illustrative example, there is a total of $N_{SA} \cdot N_{SB}$ such termination admittances 211, each receiving $1/(N_{SA} \cdot N_{SB})$ of the input power from the source 201, minus any loss due to RF dissipation and internal reflections. At the midband operating frequency $f_0$, the phase length θ separation between the reference planes d and b is one quarter-wavelength.

The combiner/divider invention in FIGS. 3*a*, 3*b* shows a coaxial output connector 521, but the output transmission line center conductor 519 may instead 1) feed an additional combiner stage, or 2) be part of a coax-to-waveguide transition, where a waveguide is the output rather than a coaxial connector 521. Also, referring to FIG. 2*a*, in one embodiment, the input center conductors 402 may be coupled to waveguide-to-coax transitions, where four waveguides replace the coaxial connectors 401 as inputs.

Figure 5A:
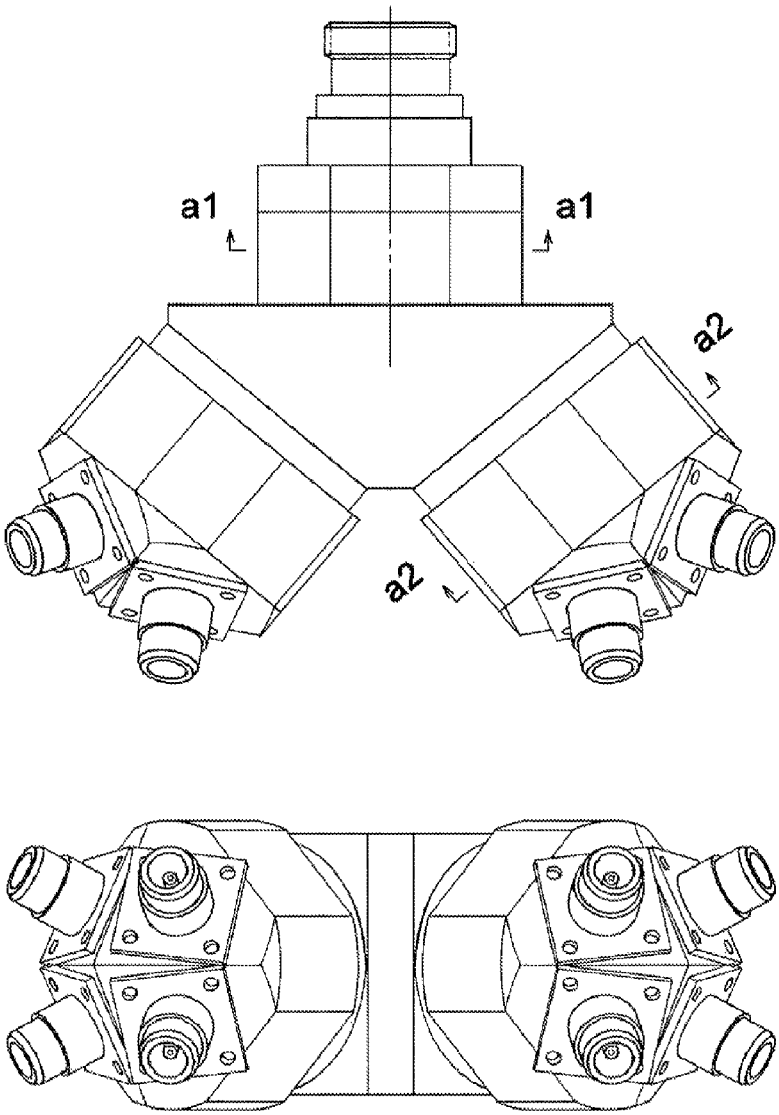
FIG. 5*a* shows orthographic and cross-sectional views along lines a1-a1 and a2-a2 of an 8 input two stage combiner.
Figure 5A:
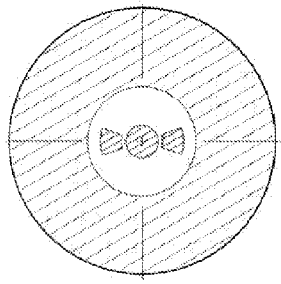
Figure 5A:
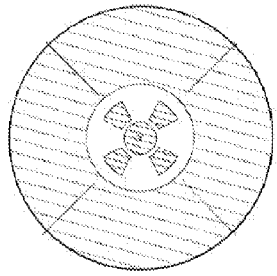

FIG. 5*a* shows orthographic and cross-sectional views along lines a1-a1 and a2-a2 of an 8 input two stage combiner. The 8-input two-stage combiner with coaxial output connector is similar to FIGS. 3*a* and 3*b*, but with each of the 4-input stage 'B' combiners rotated 45 degrees for reduced overall thickness (compared to that of FIG. 3*b*).

Figure 5B:
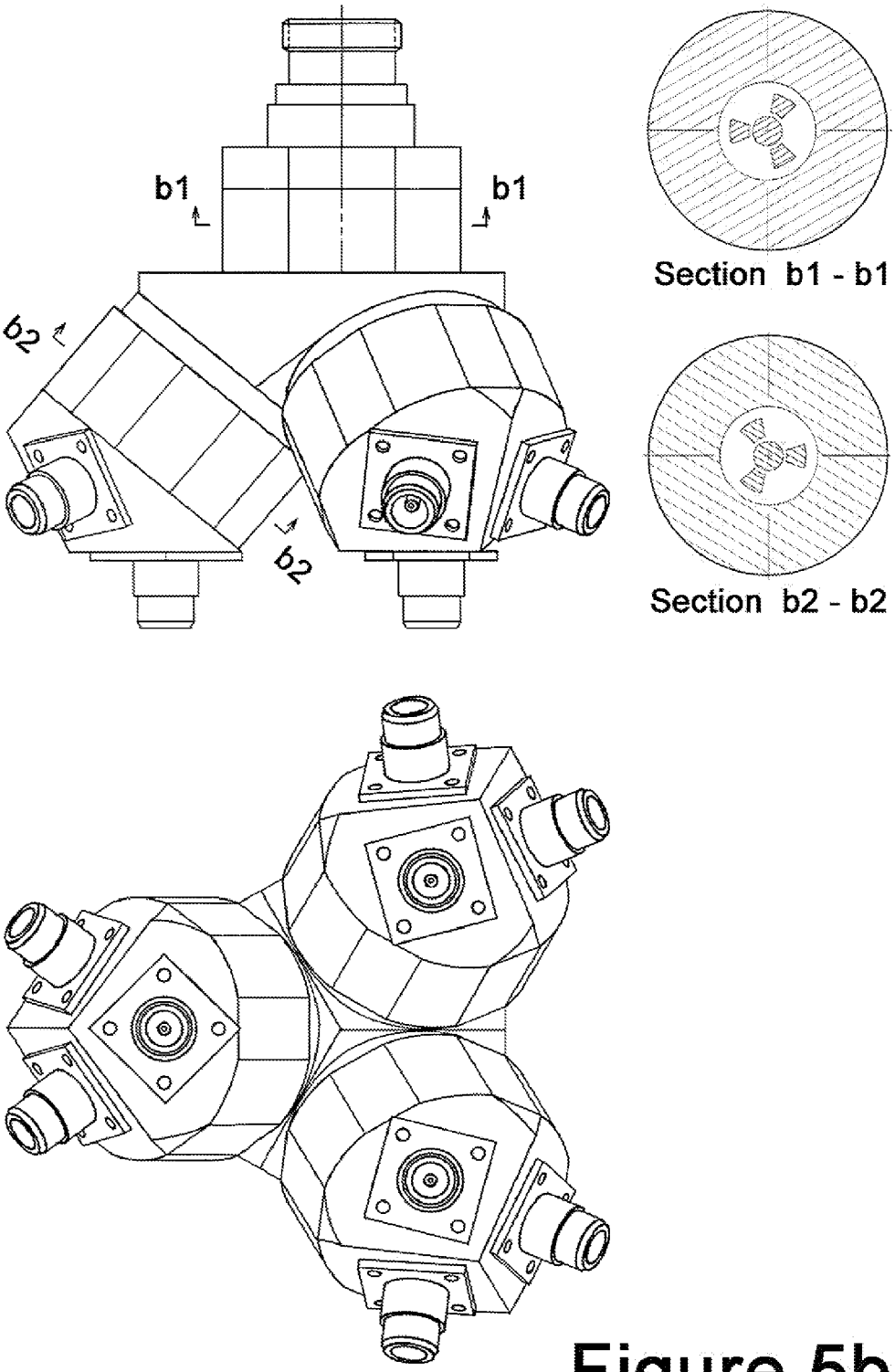
FIG. 5*b* shows orthographic and cross-sectional views along lines b1-b1 and b2-b2 of an 9 input two stage combiner.

FIG. 5*b* shows orthographic and cross-sectional views along lines b1-b1 and b2-b2 of an 9 input two stage combiner. The 9-input two-stage combiner with coaxial output connector includes one 3-input combiner comprising stage 'A' and three 3-input combiners comprising stage 'B'.

Figure 5C:
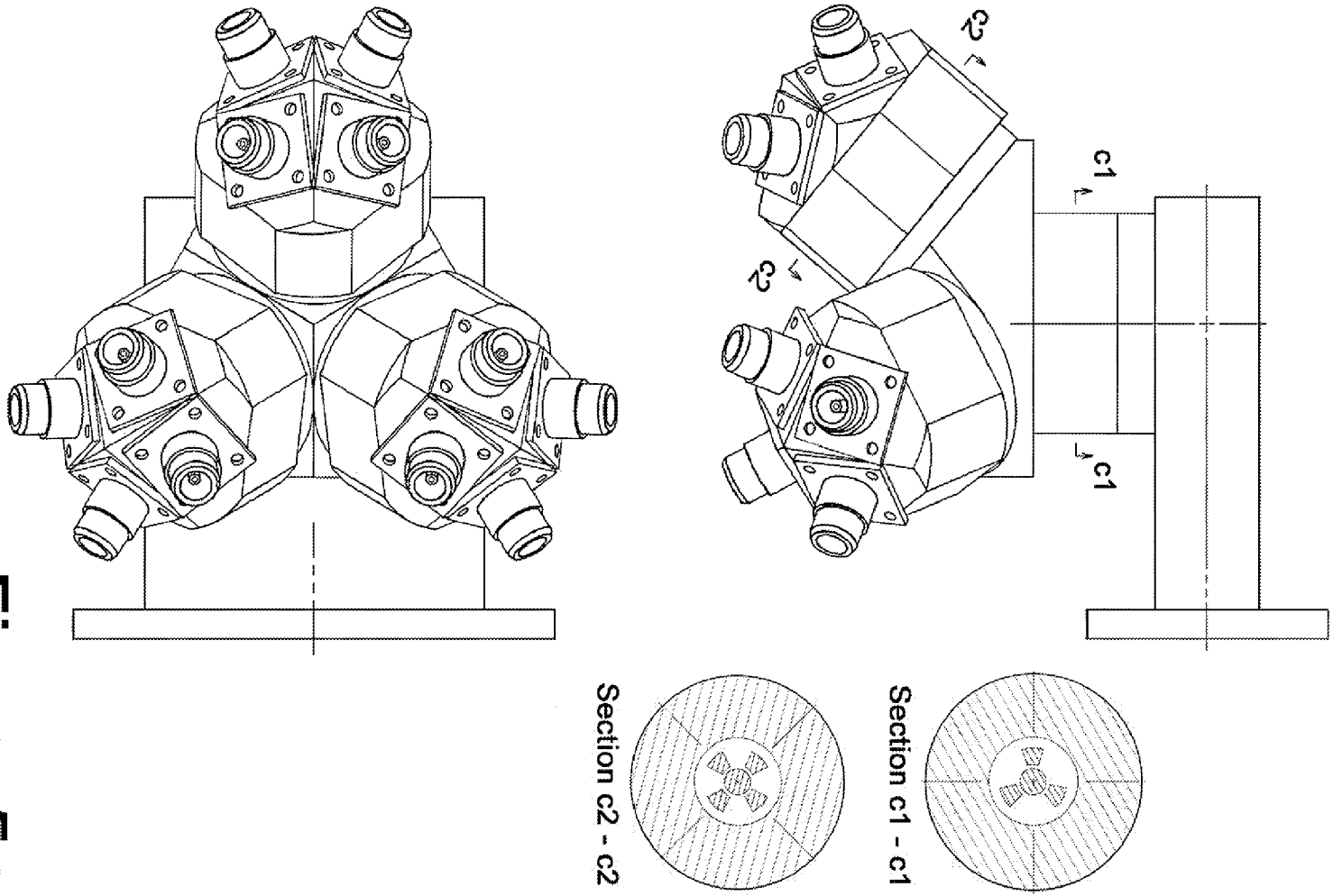
FIG. 5*c* shows orthographic and cross-sectional views along lines c1-c1 and c2-c2 of a 12 input two stage combiner.

FIG. 5*c* shows orthographic and cross-sectional views along lines c1-c1 and c2-c2 of a 12 input two stage combiner. The 12-input two-stage combiner with an output transition to rectangular waveguide includes: one 3-input combiner comprising stage 'A', and three 4-input combiners comprising stage 'B'.

Figure 5D:
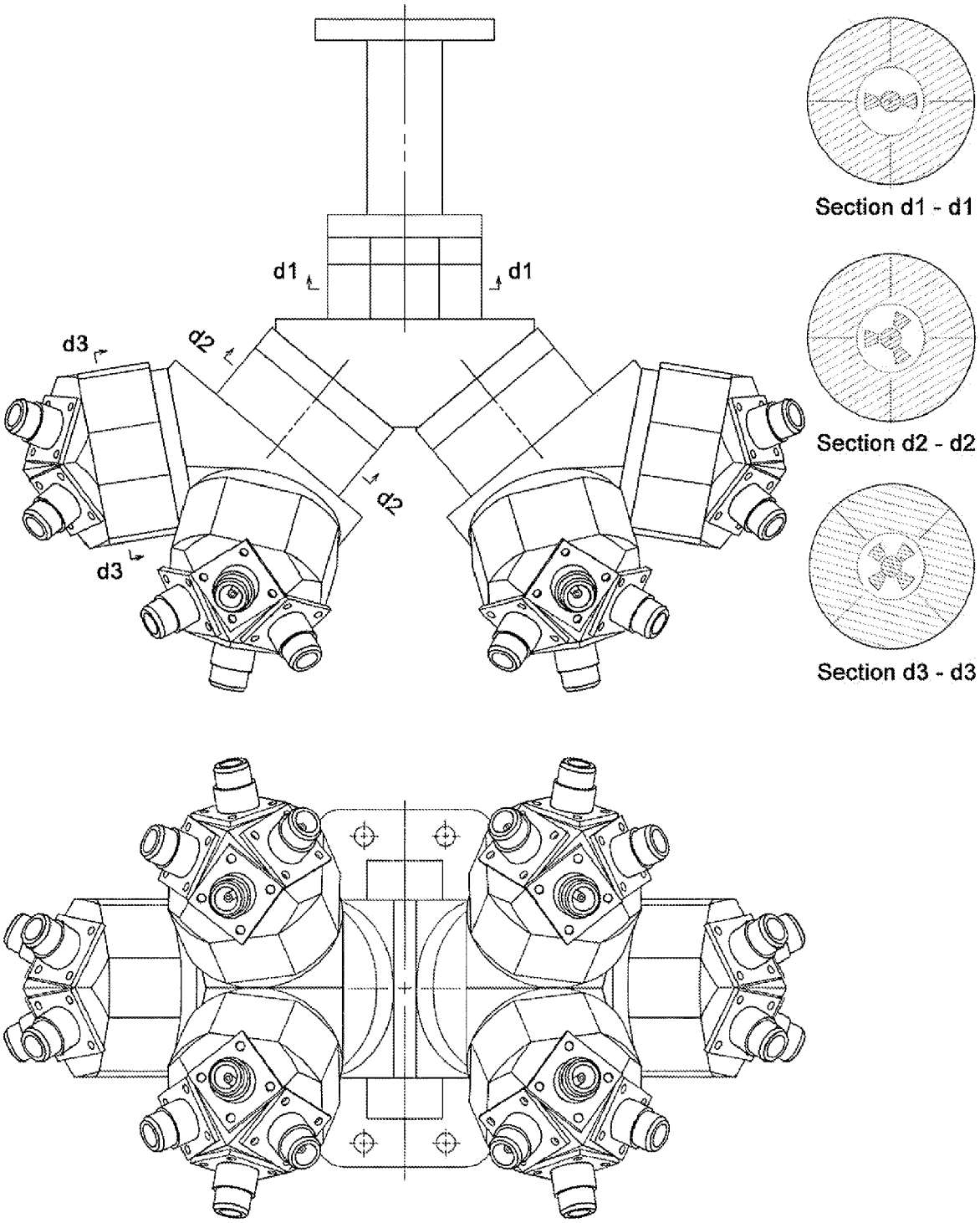
FIG. 5*d* shows orthographic and cross-sectional views along lines d1-d1, d2-d2 and d3-d3 of a 24 input three-stage combiner.

FIG. 5*d* shows orthographic and cross-sectional views along lines d1-d1, d2-d2 and d3-d3 of a 24 input three-stage combiner. The 24-input three-stage combiner includes one 2-input comprising stage 'A', two 3-input combiners comprising stage 'B', and six 4-input combiners comprising stage 'C'. The output is an end-launch coax transition to rectangular waveguide.

Having described the power combiner/dividers 400, 500 and other power combiner/dividers, various features of various embodiments of the present invention are next described. The combiner/divider of the present invention may use a smaller number of stages than the conventional combiner/divider of FIG. 1 to achieve an N-input combiner. For example, the conventional combiner/divider of FIG. 1 has three stages and seven 2-input combiner subunits for an 8-input combiner system. However, the combiner/divider of the present invention may include only two stages where, for example, a design with $N_{SA}$=2 and $N_{SB}$=4 uses only three combiner subunits instead of seven, as shown in FIG. 3*a*. Combining this advantage with each stage length being only one-quarter of a wavelength at the midband operating frequency $f_0$, the overall size of the structure may be greatly reduced compared to the conventional combiner/divider of FIG. 1. RF losses and internal reflection problems also may be greatly reduced because of the reduced size and number of subcomponents.

Figure 1:
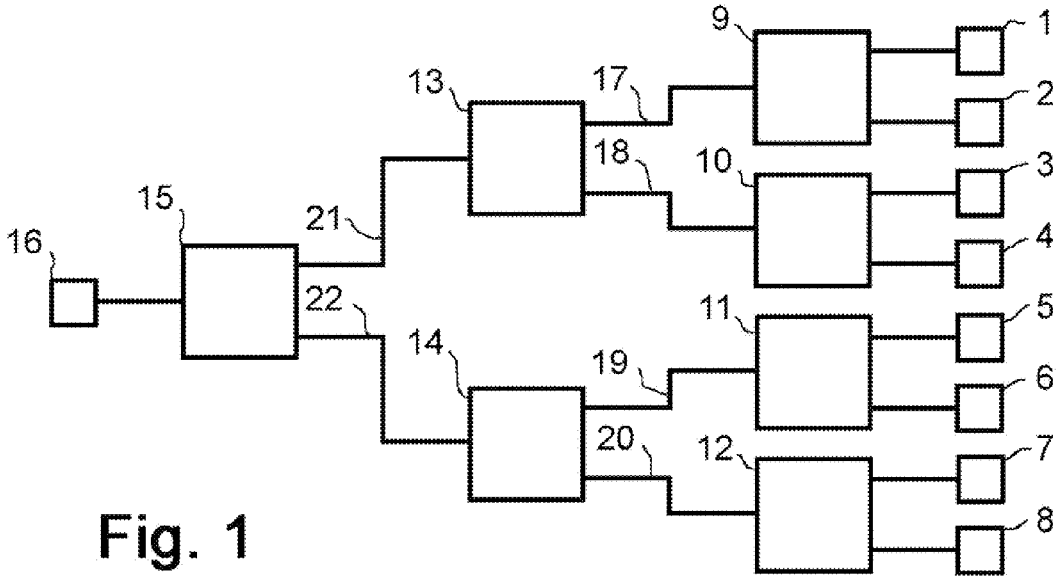
Fig. 1 (prior art)
FIG. 1 is a block diagram of a conventional three-stage corporate 'tree' structure for combining eight power amplifiers or for dividing a power source into eight equal-amplitude output signals.

The combiner/dividers 400, 500 and other power combiner/dividers of the present invention have more flexibility than the conventional combiner/divider of FIG. 1 over the number of sources that may be combined in, say for example, a two-stage combiner. The corporate tree structure of the conventional combiner/divider of FIG. 1 cannot combine twelve sources, but must use eight (three-stage) or sixteen (four-stage) sources because of the 2-input combiner subunit restriction. In contrast, the combiner/divider 500 (FIGS. 3*a*, 3*b*), may combine twelve sources (for example) using only two stages with $N_{SA}$=3 and $N_{SB}$=4, where there are three satellite conductors 511 surrounding the stage 'A' main conductor 529 (FIGS. 3*a* and 3*d*), and four satellite conductors 405 (FIGS. 2*a*, 2*b*, 3*d*) surrounding each of the three stage 'B' main transmission lines 407.

In the conventional power combiner/divider of FIG. 1, each of the seven 2-input combiner subunits 9-15 are identical and function independently from the each other. This restricts the bandwidth performance to that of the 2-input combiner subunits 9-15, minus adverse interaction effects due to the large separation between each of the seven 2-input combiner subunits 9-15. However, the power combiner/dividers 500 treats the entire corporate 'tree' as a passband filter device, according to the third aspect of the present invention, with quarter-wavelength elements throughout (defined at the mid-band frequency $f_0$). Each stage may be designed interdependently and together with the other stage(s) along with the connecting transmission lines between the stages. Accordingly, 2:1 bandwidth power combining performance for two-stage combiners (see FIGS. 4*c*), and 3:1 bandwidth performance for a three-stage combiner (see FIG. 4*d*) may be achieved, where $N_{SA}$=$N_{SB}$=$N_{SC}$=2.

The power combiner/dividers 400, 500 and other power combiner/dividers have thermal robustness due to the thermal as well as electrical connection of one end of each main and satellite conductor to ground as shown in FIGS. 2*a* and 3*a*. Any heat created due to RF dissipation loss on the main conductors 407 and 529 or the satellite conductors 405 and 511 may be thermally conducted to the ground connection. Thus every conductor within a combiner stage may serve as a thermal heat pipe to cool the overall structure. This feature allows the combiner/dividers 400, 500 to be used for power combining of high-average-power RF signal amplifiers.

Although the quarter wave length described above for the combiner/dividers 400, 500 and other power combiner/dividers are described for a midband frequency $f_0$, the quarter wave length may be based on other frequencies in the operating band. The main conductors and the satellite conductors are described above as being parallel, but may be implemented to be substantially parallel.

Although the operation of the combiners 400, 500 and other power combiner/dividers has been described as being operational with isolator-protected sources of the same frequency, relative phase and magnitude, different frequencies, relative phases and magnitudes may be used with the combiners 400, 500, depending on the applied use.

In some embodiments, the multiconductor transmission lines for the combiners 400, 500 and other power combiner/dividers may be formed using various cross-sectional shapes of the outer shield, main conductors, and/or satellite conductors, such as, but not limited to, circular, elliptical, rectangular, and hexagonal.

The terms "couple" and "connect" and their derivatives are used herein. Both terms may be used to describe embodiments in which two or more elements are in direct physical or electrical contact with each other, or two or more elements are not in direct contact with each other, but yet still co-operate or interact with each other. The embodiments are not limited in this context.

In the foregoing description, various methods and apparatus, and specific embodiments are described. However, it should be understood that various alternatives, modifications, and changes may be possible without departing from the spirit and the scope of the present invention.

What is claimed is:

1. A single stage power combiner/divider comprising:

a main conductor including a first terminal for electrical connection to a signal source and including a second terminal electrically connected to a short circuit; and a plurality of satellite conductors disposed spaced apart from and substantially parallel to the main conductor, each of the satellite conductors including a first terminal electrically connected to a short circuit and including a second terminal electrically connected to a respective termination admittance, wherein the first and second terminals of the main conductor each are thermally connected to the signal source and the short circuit, respectively, wherein the first and second terminals of the satellite conductors each are thermally connected to the short circuit and the respective termination admittance, respectively.

2. A single stage power combiner/divider comprising:

a main conductor including a first terminal for electrical connection to a signal source and including a second terminal electrically connected to a short circuit; and a plurality of satellite conductors disposed spaced apart from and substantially parallel to the main conductor, each of the satellite conductors including a first terminal electrically connected to a short circuit and including a second terminal electrically connected to a respective termination admittance, wherein the main conductor is a center conductor, and the plurality of satellite conductors are arranged in a cross section symmetrically about the main conductor.

3. The single-stage power combiner/divider of claim 2, wherein the plurality of satellite conductors each have substantially identical cross-sections, perimeters of each satellite conductor being symmetric about an axis of the main conductor with respect to each other.

4. The single-stage power combiner/divider of claim 3, wherein the main conductor has a circular cross section.

5. The single-stage power combiner/divider of claim 3, wherein the main conductor has a rectangular cross section.

6. The single-stage power combiner/divider of claim 3, further comprising a conductive shield having an inner surface with a circular cross section and having a hollow interior, the main conductor and the satellite conductors being disposed substantially parallel to the inner surface and disposed in the hollow interior of the conductive shield.

7. The single-stage power combiner/divider of claim 3, further comprising a conductive shield having an inner surface with a rectangular cross section and having a hollow interior, the main conductor and the satellite conductors being disposed substantially parallel to the inner surface and disposed in the hollow interior of the conductive shield.

8. A single stage power combiner/divider comprising:

a main conductor including a first terminal for electrical connection to a signal source and including a second terminal electrically connected to a short circuit; and a plurality of satellite conductors disposed spaced apart from and substantially parallel to the main conductor, each of the satellite conductors including a first terminal electrically connected to a short circuit and including a second terminal electrically connected to a respective termination admittance, wherein a homogeneous multiconductor transmission line comprising the main conductor and the plurality of satellite conductors has an effective phase length that is about one-quarter of a wavelength at a mid-band operating frequency.

9. A single stage power combiner/divider comprising:

a main conductor including a first terminal for electrical connection to a signal source and including a second terminal electrically connected to a short circuit; and a plurality of satellite conductors disposed spaced apart from and substantially parallel to the main conductor, each of the satellite conductors including a first terminal electrically connected to a short circuit and including a second terminal electrically connected to a respective termination admittance, wherein the main conductor and the plurality of satellite conductors each have a thermal conduction path to the corresponding short circuit.

10. A two-stage power combiner/divider comprising:

a first power combiner/divider stage comprising:

a first main conductor including a first terminal for electrical connection to a signal source and including a second terminal electrically connected in to a short circuit, and a plurality of first satellite conductors disposed spaced apart from and substantially parallel to the first main conductor, each of the first satellite conductors including a first terminal electrically connected in to a short circuit and including a second terminal;

a plurality of transmission lines, each transmission line including a first terminal electrically connected to a respective second terminal of a first satellite conductor and including a second terminal; and a second stage comprising a plurality of power combiners/dividers, each power combiner/divider comprising:

a second main conductor including a first terminal electrically connected to the second terminal of a corresponding transmission line and including a second terminal electrically connected to a short circuit, and a plurality of second satellite conductors disposed spaced apart from and substantially parallel to the second main conductor, each of the second satellite conductors including a first terminal electrically connected to a short circuit and including a second terminal electrically connected to a corresponding termination admittance.

11. The two-stage power combiner/divider of claim 10, wherein the first and second terminals of the first main conductor each are thermally connected to the signal source and the short circuit, respectively, wherein the first terminals of the first satellite conductors each are thermally connected to a short circuit, wherein the first terminals of the transmission lines each are thermally connected to the respective second terminal of a first satellite conductor, wherein the first and second terminals of each second main conductor each are thermally connected to the second terminal of a corresponding transmission line and the short circuit, respectively, wherein the first and second terminals of the second satellite conductors each are thermally connected to the short circuit and the corresponding termination admittance, respectively.

12. The two-stage power combiner/divider of claim 10 wherein the first main conductor is a center conductor, and the plurality of first satellite conductors are arranged in a cross section symmetrically about the first main conductor, wherein each second main conductor is a center conductor, and the plurality of second satellite conductors are arranged in a cross section symmetrically about the second main conductor.

13. The two-stage power combiner/divider of claim 12, wherein the plurality of first satellite conductors each have substantially identical cross-sections, perimeters of each of the first satellite conductors being symmetric about the axis of the first main conductor with respect to each other, wherein the plurality of second satellite conductors each have substantially identical cross-sections, perimeters of each of the second satellite conductors being symmetric about the axis of each second main conductor with respect to each other.

14. The two-stage power combiner/divider of claim 13, wherein the first power combiner/divider stage further comprises a first conductive shield having an inner surface with a circular cross section and having a hollow interior, the first main conductor and the first satellite conductors being disposed substantially parallel to the inner surface and disposed in the hollow interior of the first conductive shield, and wherein each power combiner/divider of the second stage further comprises a second conductive shield, the conductive shield having an inner surface with a circular cross section and having a hollow interior, the second main conductor and the second satellite conductors of the power combiner/divider being disposed substantially parallel to the inner surface and disposed within the hollow interior of the second conductive shield.

15. The two-stage power combiner/divider of claim 13, wherein the first power combiner/divider stage further comprises a first conductive shield having an inner surface with a rectangular cross section and having a hollow interior, the first main conductor and the first satellite conductors being disposed substantially parallel to the inner surface and disposed in the hollow interior of the first conductive shield, and wherein each power combiner/divider of the second stage further comprises a second conductive shield, the conductive shield having an inner surface with a rectangular cross section and having a hollow interior, the second main conductor and the second satellite conductors of the power combiner/divider being disposed substantially parallel to the inner surface and disposed within the hollow interior of the second conductive shield.

16. The two-stage power combiner/divider of claim 12, wherein the first and second main conductors have circular cross sections.

17. The two-stage power combiner/divider of claim 12, wherein the first and second main conductors have rectangular cross sections.

18. The two-stage power combiner/divider of claim 10, wherein the first and second main conductors and the pluralities of first and second satellite conductors each has an effective phase length that is about one-quarter of a wavelength at a mid-band operating frequency.

19. The two-stage power combiner/divider of claim 10, wherein the first and second power combiner/divider stages are separately and independently optimized for impedance match and power division at the mid-band operating frequency only.

20. The two-stage power combiner/divider of claim 10, wherein each of the multiconductor transmission lines has an effective phase length that is about one-quarter of a wavelength at the mid-band operating frequency, and cross section admittance matrices of each of the first and second power combiner/divider stage multiconductor transmission lines and the admittances of the plurality of transmission lines all have characteristics that form in combination a passband filter.

21. The two-stage power combiner/divider of claim 10, wherein the first and second main conductors and the pluralities of first and second satellite conductors each have a thermal conduction path to the corresponding short circuit.

* * * * *